US006397908B1

(12) United States Patent
Büchs

(10) Patent No.: US 6,397,908 B1
(45) Date of Patent: Jun. 4, 2002

(54) DEVICE FOR DISPENSING LIQUID FROM A BOTTLE

(76) Inventor: Yves Büchs, 1, Place Voltaire, F-94200 Ivry-sur-Seine (FR)

( * ) Notice: Subject to any disclaimer, the term of this patent is extended or adjusted under 35 U.S.C. 154(b) by 0 days.

(21) Appl. No.: 09/647,738

(22) PCT Filed: Feb. 4, 2000

(86) PCT No.: PCT/FR00/00273

§ 371 (c)(1),
(2), (4) Date: Oct. 4, 2000

(87) PCT Pub. No.: WO00/46144

PCT Pub. Date: Aug. 10, 2000

(30) Foreign Application Priority Data

Feb. 4, 1999 (FR) ..... 99 01316

(51) Int. Cl.[7] ..... B65B 1/04; B65B 3/00; B67C 3/00

(52) U.S. Cl. ..... 141/351; 141/285; 141/291; 141/360; 141/362

(58) Field of Search ..... 141/250, 255, 141/281, 283, 285, 291, 296, 311 R, 351, 360, 362; 222/506, 507, 509, 511, 513, 526, 529, 544, 545

(56) References Cited

U.S. PATENT DOCUMENTS 2,801,032 A * 7/1957 Hall ..... 222/449
4,903,742 A 2/1990 Gagnon
5,042,698 A * 8/1991 Fessell ..... 222/481.5
5,332,127 A 7/1994 White
5,431,205 A 7/1995 Gebhard
5,848,736 A 12/1998 Boumann

FOREIGN PATENT DOCUMENTS

| | | |
|---|---|---|
| DE | 875 456 | 5/1953 |
| DE | 88 09 596.7 | 10/1988 |
| DE | 94 01 797.2 | 6/1994 |

* cited by examiner

*Primary Examiner*—Timothy L. Maust
(74) *Attorney, Agent, or Firm*—Young & Thompson

(57) ABSTRACT

A light and economical device for dispensing a liquid easily adaptable to bottles of standard format, called fountain or dispenser. The device is in the form of a valve cartridge whereof the opening can be controlled by simple pressure, including elements for being adapted, interchangeable, sealed and for being fixed to one or several types of bottle necks of standardized format, self-contained elements for controlling air intake when the liquid is drawn, self-contained elements for regulating the liquid flow rate, and a receiving and controlling element, securely maintaining the cartridge, and elements for easily controlling the dispensing of liquid either directly, or indirectly when the control device is delayed or when the device is integrated in another complementary system such as a cooling or heating system. The device has adaptable shapes and sizes for multiple applications: individual portable fountain operated with one hand, dispenser for antiseptics, washing liquid, and others for domestic or business purposes.

9 Claims, 4 Drawing Sheets

DEVICE FOR DISPENSING LIQUID FROM A BOTTLE

CROSS-REFERENCE TO RELATED APPLICATION

This is the 35 USC 371 national stage of international application PCT/FR00/00273 filed on Feb. 4, 2000, which designated the United States of America.

FIELD OF THE INVENTION

The present invention concerns a device offering direct or indirect controlled dispensing of a liquid from a bottle called dispenser or fountain.

BACKGROUND OF THE INVENTION

For one thing the conception of traditional fountains is based either on the adaptation of specific water containers, with a specific stopper without offering the autonomous functions of controlling air flow intake, liquid flow and dispensing, or on a direct connection to a water or liquid network, not offering the double possibilities to serve liquid directly from a standardized bottleneck bottle and indirectly when the device is completed with, for example, a cooling or heating system while being easily adaptable on any standardized format bottles.

On the other hand, there is on the market containers of mineral water or any kind of liquid having an increasing volume: five liters bottles, one gallon bottles, 10 liters bottles which are relatively heavy and which also present sometimes, a too great liquid flow because of their broad bottleneck. Up to this date, there is no available system which can easily fit on any kind of available mineral or spring water bottles available in large-scale distribution, in order to offer the same kind of service whatever the consumer choice.

Furthermore in this particular field, the spring or mineral water consumption from bottles is an answer to new increasing needs based on individualized criteria for which the large fountains, mainly intended for collective uses, are incapable to meet, as said fountains can't offer a possibility of individual choice as for the type of container and contents, and in addition, for weight bulky and handling criteria, are not really adaptable to the various and numerous small economic liberal, commercial or familial entities.

Therefore, the existing kinds of fountain systems are not particularly conceived for a light and individual use and are limited to a specific use. The traditional devices cannot offer simultaneously a possible use directly from the bottle, and indirectly, when completed with, for example, with a cooling or heating device, and are not easily adaptable at low cost to any kind of yet mainly standardized bottles which are available in large-scale distribution.

SUMMARY OF THE INVENTION

Thus, the present invention proposes technical remedies to these above-mentioned disadvantages, by simple, reliable, and easy to implement means.

According to the principal characteristic, the device, called dispenser or fountain, presents a kind of cartridge with a valve which can be opened by simple pressure, comprising simple means of adaptation, interchangeability, watertightness and for fixing on one or different kinds of standardized format bottlenecks, autonomous means for controlling air flow intake during liquid output, autonomous means for regulating liquid flow and retaining said liquid and an element of reception and control, firmly maintaining the cartridge and providing means for controlling liquid dispensing either directly or, indirectly, when the device according to the invention is inserted in another complementary system such as a cooling or heating system.

According to a complementary characteristic, the means of interchangeability, watertightness and for fixing the cartridge on one or several types of standardized bottlenecks, include at least one easily adaptable or changeable element, which can be in the form of a double stopper integrating the passage of liquid into the cartridge, being fixed both on the bottleneck and on the casing of the cartridge and comprising one or more watertight adaptative concentrically laid out or juxtaposed on a same support making the cartridge adaptable to various types of bottlenecks.

According to another characteristic, the air flow intake control means are ensured by one or more permanent air openings feeding an air pocket retained between a membrane—located between the part fixed to the bottleneck and the rest of the casing, and a flexible device acting as an air valve authorizing only the passage of the air inward the bottle, by sucking up during the liquid discharging.

According to another characteristic, the means for controlling liquid discharge are ensured by at least one membrane including at least one opening or tube regulating the flow of the outgoing liquid from the bottleneck and at least one opening letting the air go up.

According to another characteristic, the autonomous means for retaining the liquid and for controlling its dispensing comprise at least one element acting as a watertightness valve retaining the liquid in a "closed" position, closely embracing the cartridge shape under the liquid pressure or under an additional permanent pressure from any flexible device (fine plastic strips or any spring for example) releasing the liquid out when said valve is pushed in the cartridge and a vertical slip towards the interior (a tetrahedral, spherical, pyramidal or conical shape or also in a form of "T", "Y"), the smallest tip in the bottom, exceeding or not the nozzle and being able to be prolonged by a tube being used both to guide its movement precisely and to guide the liquid out which enters it by side openings during the pushing of the valve in the cartridge on the "open" position.

According to another characteristic, the device includes one or several elements ensuring the reception of the cartridge, maintaining it firmly in vertical position, providing the ventilation of the cartridge and ensuring the active or passive dispensing commands.

The whole and the combination of the preceding characteristics allows advantageously a double possibility of liquid dispensing either directly from the cartridge or indirectly through complementary half-closed circuit device such as a cooling or heating system, while ensuring an autonomous regulation and control of the liquid flow and air intake.

According to another characteristic, the cartridge reception device can offer in only one piece a complete set of commands for liquid dispensing such as a lever, only attached by a thin articulation zone, including the necessary element to raise the valve inside the cartridge, a tubular protuberance which surmounts the central opening of the liquid dispensing lever, and one or two means of command in the form of a front-end pressure button and of a strip located behind the liquid dispensing opening, one to be activated by a finger, the other by a container such as a glass, the whole device being able to be manufactured in only one molding operation, particularly for plastic injection.

According to an alternative of use of the dispenser, the liquid dispensing commands, normally located on the device intended to receive the cartridge, can be directly located on the cartridge making it entirely autonomous.

According to various alternatives of use, the liquid dispensing device comprises necessary means for several types of applications such as, for example, its adaptation to a mural disinfectant liquid dispenser for bathroom (mouthwash).

BRIEF DESCRIPTION OF THE DRAWINGS

Other characteristics and advantages of the invention will emerge from the description, which will follow with regards to the annexed drawings which are non limitative examples.

The annexed drawings illustrate the invention.

DETAILED DESCRIPTION OF THE INVENTION

Figure 1:
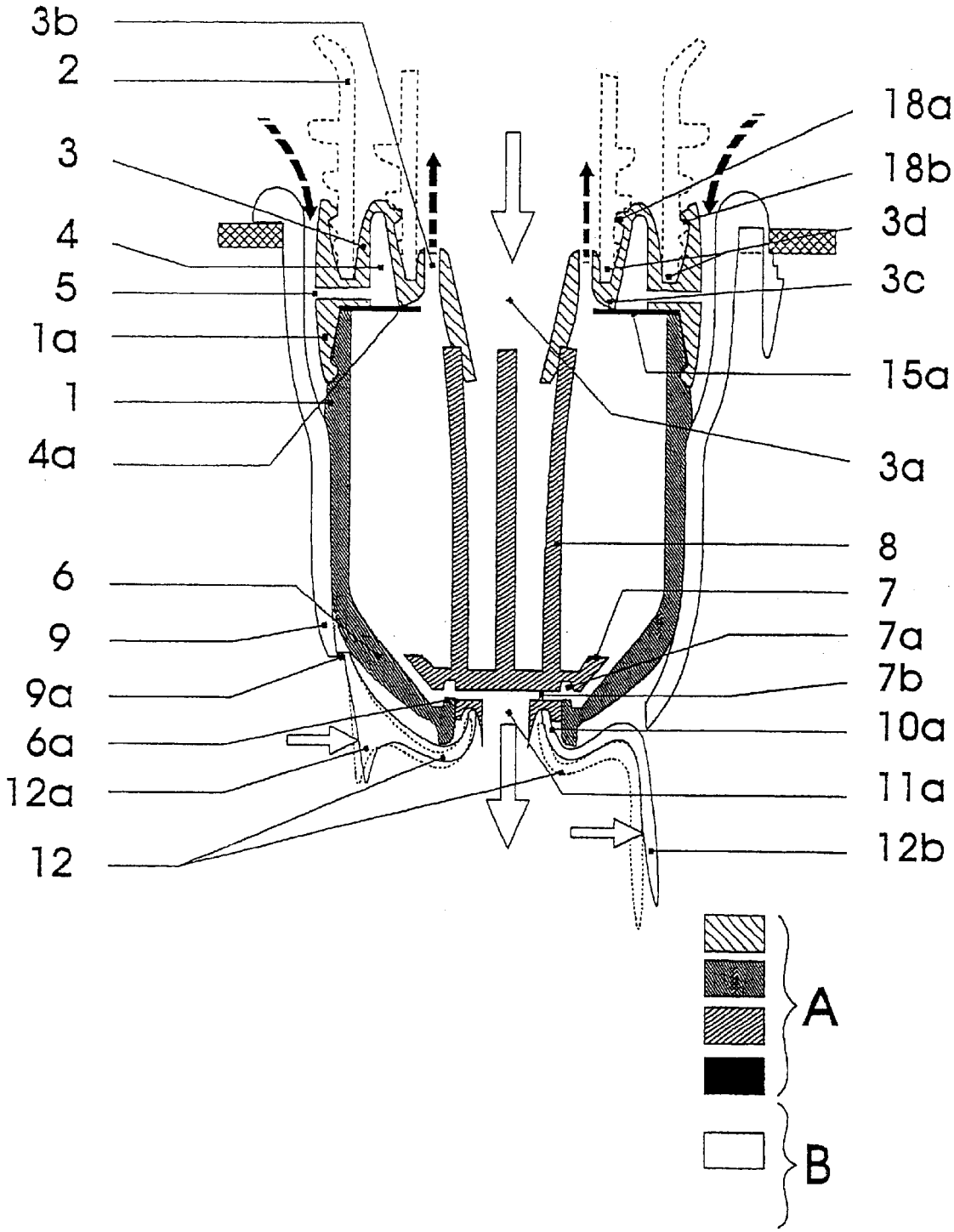
FIG. 1 represents a section of an example of the three essential sets of the device of the invention: the cartridge, the cartridge reception device and an example of a manual control opening system.
Figure 2:
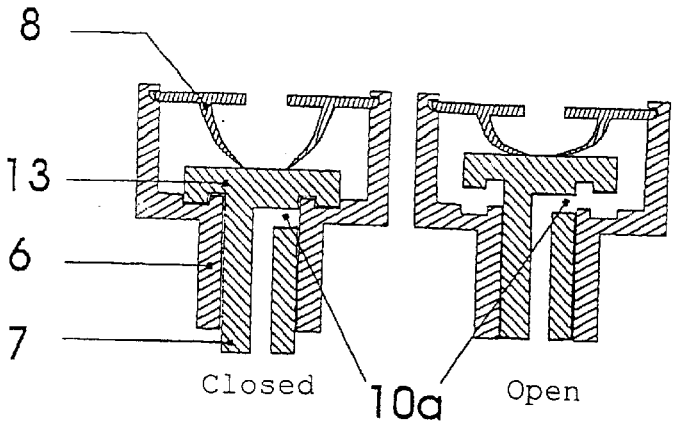
FIG. 2 represents a section of an alternative of the valve.
Figure 3:
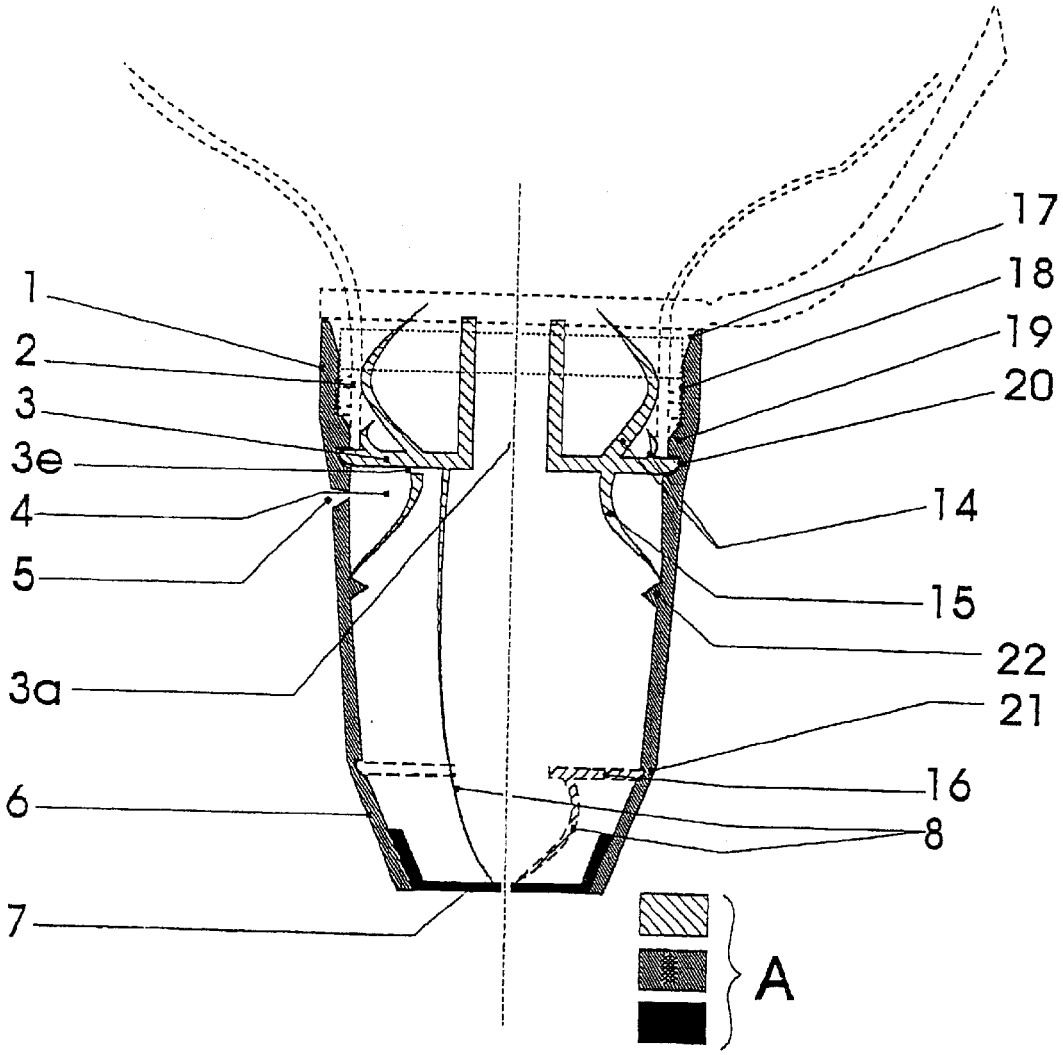
FIG. 3 represents a section of an alternative of the cartridge and of the opening system.
Figure 4:
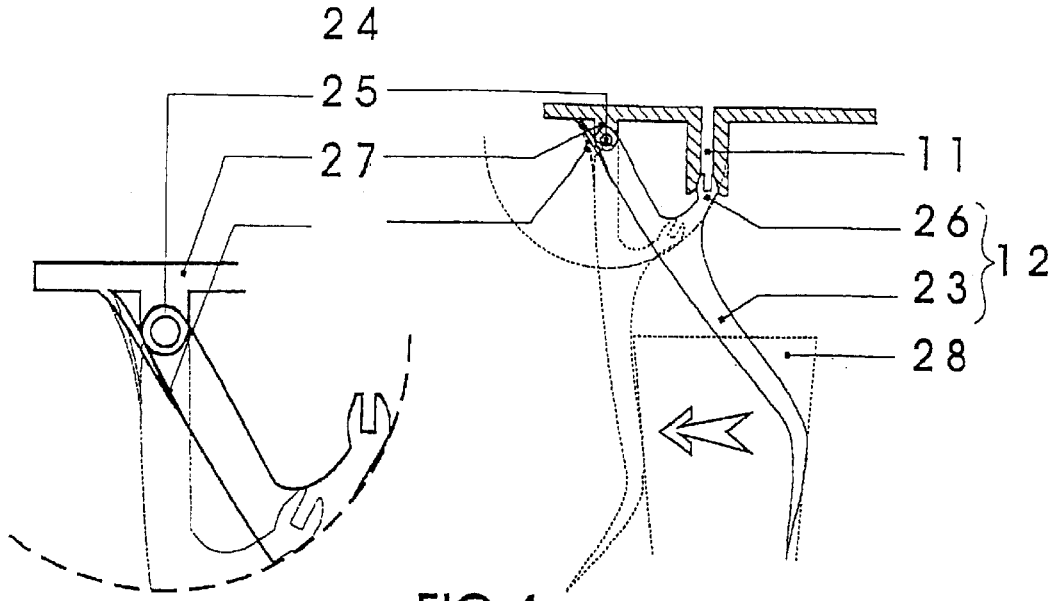
FIG. 4 represents another alternative of the opening system.
Figure 5:
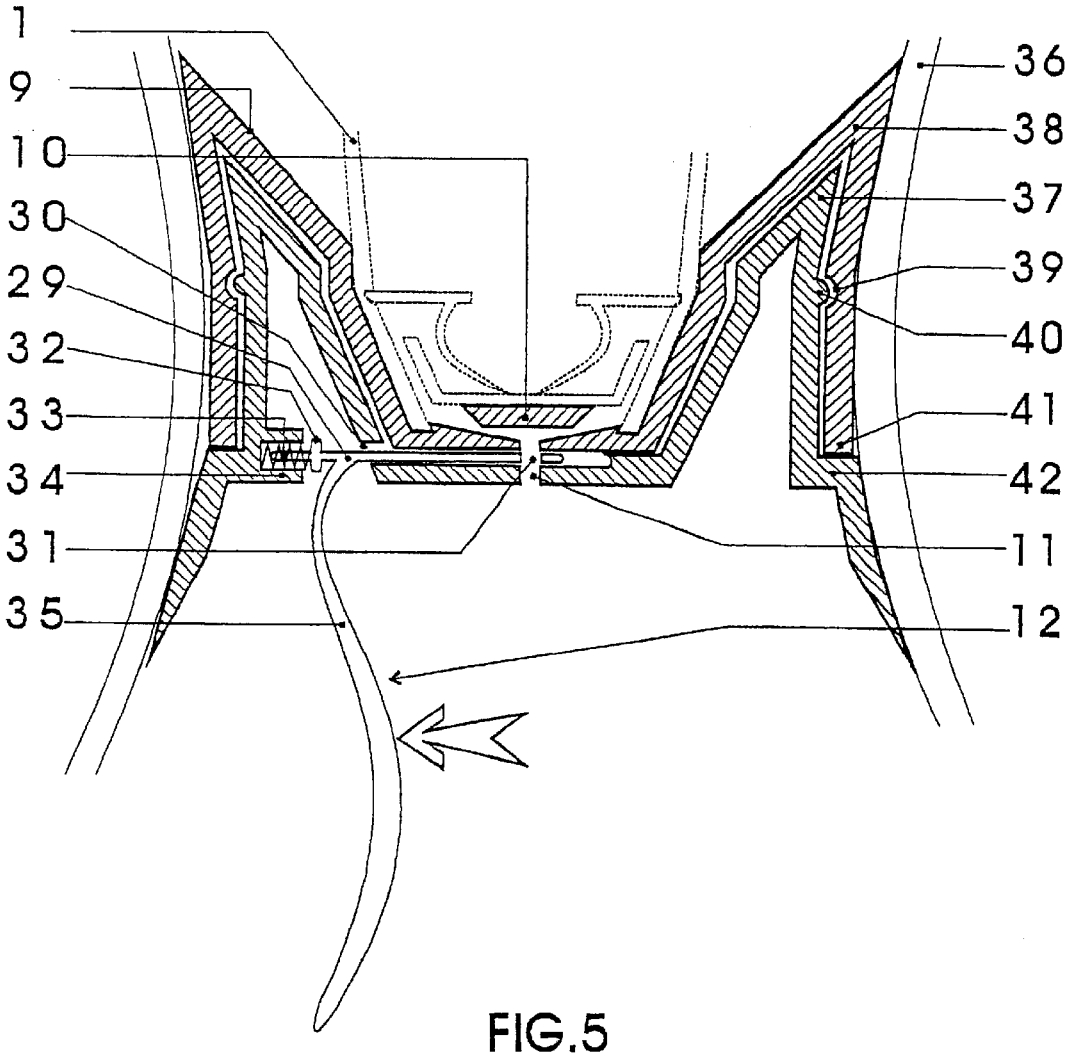
FIG. 5 represents a section of an alternative of the device of reception of the cartridge and another alternative of the opening system.

In reference to these drawings, the whole of the dispenser or fountain appears as a cartridge (A) adaptable to one or more bottles with standardized format bottlenecks (2) and of a reception and command device (B), maintaining the cartridge (A), allowing the air flow intake (5) and providing the means for an easy liquid dispensing. The cartridge (A) with a valve (7) which can be opened on command (12, 12*a*, 12*b*) by simple pressure, includes means of interchangeability, of watertightness (3*d*, 14, 19) and of fixation (1*a*, 14, 18, 18*a*, 18*b*) to one or more type of bottlenecks (2), autonomous means of control of the air flow intake (3*b*, 4, 4*a*, 5, 15, 15*a*) during the liquid discharging, autonomous means for regulating the flow of said liquid (3, 3*a*) and means for controlling said liquid dispensing (6, 6*a*, 7, 7*a*, 7*b*, 8, 9, 9*a*, 10, 10*a*, 11, 11*a*, 12, 12*a*, 12*b*) either directly from the cartridge or indirectly with differed commands or when the device according to the invention is inserted in another complementary system such as a cooling or heating device.

According to the invention, the means of interchangeability, watertightness and for fixing the cartridge (A) to one or more types of standardized bottleneck (2), are constituted by least of one easily adaptable or changeable element (1, 1*a*), which can be in the form of a double stopper (1*a*) including the liquid passage (3*b*) in the cartridge (A), fixed both to the bottleneck (2) and on the cartridge casing (1) and comprising one or more adapted fixing means (18, 18*a*, 18*b*) (scratches, screw, truncated screw, etc), concentrically laid out or juxtaposed on a same support called membrane (3), thus taking liquid dispensing from one or more types of bottleneck (2) slipping into a slightly widened watertightness site (3*d*) provided in the support (3) eventually assisted by an additional fine watertightness edge (lip).

According to the invention, the air intake flow supply and control means during the liquid dispensing are ensured by one or more permanent air openings (5) that supply an air pocket (4) retained between a membrane (3)—which is located between the part fixed to the bottleneck (1*a*) and the rest of the casing (1), and a flexible device (15, 15*a*) which is used as an air valve (15, 15*a*) authorizing only the passage of the air (4*a*, 3*b*) inward the bottle by sucking up created during liquid discharging while insulating the air pocket (4) from the liquid.

According to the invention, the cartridge (A) includes the means for controlling the liquid flow which are ensured by at least one membrane (3) included in the element of fixation to the bottleneck (1*a*) or inserted in a cavity (20) of the cartridge casing (1) by means of at least one opening or tube (3*a*) controlling the liquid flow from the bottleneck (2) of the bottle and at least one opening (3*e*) letting the air go up.

According to the invention, the means for retaining the liquid and for controlling said liquid dispensing are constituted by at least one element acting as a water valve (7) retaining in watertightness the liquid in the "closed" position, closely embracing the cartridge shape (6) under the liquid pressure and under a supplementary permanent pressure from any flexible device (8) (thin plastic strips or spring, for example) releasing the liquid out only when said valve (7) is pushed towards the interior of the cartridge (A), the basis of sa id valve (7) having a form which allows at the same time a good support within the cartridge (A) and a vertical slip inward the interior of said cartridge (a tetrahedral, spherical, pyramidal or conical shape or also in a form of "T" (13), "Y"), the smallest end inward the bottom, exceeding or not the opened end of the nozzle (6) and being able to be prolonged by a tube used both to precisely guide its movement in a passage of the reception device (B) purposely provided and to guide the liquid which enters it by side openings (7*b*) during the pushing of the water valve (7) inward the cartridge (A) on the "open" position. Its watertightness can be reinforced by any well-known means such as an O-ring joint or a gutter (7*a*) conceived under the valve (7), as a slightly widened ring in which a male annular form (6*a*), located around the opening (11), at the nozzle of the cartridge (6), or vice versa, is perfectly inserted.

According to the invention, the complementary device (B) ensures the cartridge (A) reception, and maintains it firmly in vertical position by means of a receptacle (9) which closely embraces the cartridge shape while allowing a free passage for the air intake (5), providing the active or passive commands (10, 10*a*, 12, 12*a*, 12*b*) when the dispensing commands are provided for acting differently on the same device or when said device is provided for being inserted in a complementary device having its own commands of liquid dispensing. A protuberance (10), located at the bottom of the reception device (B) or on one of its elements (10*a*), pushes the valve (7) inside the cartridge (6) in order to release the liquid on the valve periphery (7) towards an opening or a liquid dispensing tube (11) which can be opened by a manually actuated device (12) or any other means.

According to a first mode of realization, the part of the cartridge (1*a*) fixed to the bottleneck (2) is independent. It can have the shape of a double stopper with the normal watertightness characteristics (3*d*) and be fixed both on one side to the bottleneck (2) and on the other side to the cartridge casing (1), with a lower surface whose form is adapted there to include an air pocket (4), the necessary air flow openings (5) and the passage of the air inward the bottle (4*a*, 3*b*). This independent part of the cartridge (1*a*) can also present one or more than one juxtaposed adaptations (3*d*, 18*a* and 18*b*) to various bottlenecks diameters (1.5 l and 5 liters for example) concentrically laid out on the same support acting as a membrane (3) and with the same central tubular opening (3*a*).

According to the preceding mode of realization, the air flow control is ensured by a thin washer (15*a*) made from a flexible material inserted between the casing (1) and the independent part of fixation (1*a*) to the bottleneck (2) ensuring both the watertightness of the cartridge and control of air intake flow. This washer (15*a*) will also preserve, such as a peripheral membrane around the axis of circulation of the liquid, the air pocket (4) by a circular contract located near the liquid flow opening (3*a*) of the membrane (3) with a minimum and significant contact on a circular protuberance (3*c*) of said membrane, acting as air valve letting only the air go up (4*a*, 3*b*) in the bottle.

According to another alternative of realization, the cartridge (1) can be directly fixed to a bottleneck (2). An open membrane with an opening or central tube (3), inserted in the casing of the cartridge (1) presents then two higher flexible and convex crowns (14), the largest of said crowns ensuring the watertightness duty and exerting a holding pressure inside the bottleneck, the other smaller reinforcing the watertightness at the end of the bottleneck (2). It also presents a lower crown (15) thinly ventilated in its intersection (3*e*) with the membrane (3) letting the air go up during the liquid dispensing and joining an edge (22) of the wall of the cartridge (1) to ensure the protection of the air pocket (4) and air intake cartridge opening or openings (5). A whole of thin and long flexible strips, a spring or any other device (8) maintains firmly the water valve (7) at the bottom of the end of the nozzle of the cartridge (6).

According to the preceding alternative, the casing of the cartridge (1) can have a widened shape on its edge (17), then can present inside thin grooves (18) to clutch the bottleneck (2), in the absence of an adapted screw thread, then can be bent inward the interior (19) up to the site of the end of the neck (2) in order to take part in the watertightness. It comprises the cavities (20 and 21) and the necessary peripheral borders (22) for the insertion of the membranes and the protection of the air pocket (4) and the cartridge air intake opening or openings (5). The nozzle of the cartridge (6) fulfills the watertightness requirements of the water valve (7) and embraces the shapes of said valve.

According to various alternatives of realization of the casing of the cartridge (1) and valve (7), a second membrane with one opening or central tube (16) can be provided for directing the liquid and maintaining, by means of its thin flexible strips or spring (8), the valve (7) at the bottom of the nozzle of the cartridge (6). Each one of these membranes (3 or 16) and their characteristics can be made out of plastic in only one injection molding operation.

According to a mode of realization of the cartridge reception device (B), said device can offer out the whole elements of autonomous command and liquid dispensing, by including, in only one piece solely attached by a thin articulation zone (9*a*), the set of dispensing commands such as a lever (12) including the necessary element to raise the valve (7) inside the cartridge (A) such as a tubular protuberance (10*a*) which surmounts the central opening (11*a*) of the liquid dispensing lever (12), and one or two means of command in the form of a front-end pressure button (12*a*) and of a strip (12*b*) located behind the liquid dispensing opening (11*a*), one to be pushed by the finger, the other by a container such as a glass, the whole device being able to be manufactured in only one molding operation, particularly for the plastic injection.

According to another alternative of realization of the liquid dispensing opening device, it can be presented in the form of a closing nozzle lever (23) held to an articulation axis (24) by perforated legs (25), or constituted by a thin zone (plastic under injection). This axis (24) is located above the level and close to water dispensing opening (11) so that the end of the lever closing device (26), as well as the end of the dispensing opening (11) are, at the shortest interval, on the circumvolution tangent around this axis. The closing nozzle (26) tightly penetrates the dispensing opening of the reception device (11) which opening has an end that is slightly conical and is round on its edge. The level closing end (26) is hollow and also of slightly conical and round shape. The necessary pressure for right closing is ensured by a flexible device (27) closely located to the axis (24) (steel strip, plastic tongues provided in the body of the cartridge reception device or any other means). The closing nozzle lever (23) has a form such as, as soon as it is pushed by a glass (28) or all other container, the perpendicular axis to the opening (11) is completely free from any obstacle for a good vertical flow.

According to another alternative of realization of the opening device (12) of the cartridge reception device or dispensing tube (11), said opening device can have the form of a (plastic or metal) strip (29) which slips into a suitable channel (30). It comprises on its end an opening (31) substantially equal to that of the cartridge reception device (11) and, at the other end, a protuberance (32) retaining the spring (33) which causes the closing operation (shift of the openings). The spring (33) is inserted in a cylindrical cavity of the cartridge reception device (34), the opening (juxtaposition of all the openings) is obtained by a pressure on a contiguous lever (35) or a simple button (not-illustrated) in prolongation of the strip then crossing the cartridge reception device (9) and the support (36), if any.

According to a not-illustrated alternative of realization of the dispenser, the whole cartridge device (1) except for what relates to the water valve (7) can be an integral part of the cartridge reception device (B) provided with its system of opening (12) which will then be attached up side down on the bottle before being turned over.

According to another alternative of realization of dispenser, the cartridge reception device (9), the support (36) and the opening mechanism (12) are here within a coherent and complementary set since they comprise original forms for a specific assembly. The cartridge reception device (9) is composed of a lower part (37) encasing itself under the higher part (38), the two parts respectively closely embracing each other on the bottom and the top of the support widened shape (36) (conical, spherical, tetrahedral or pyramidal) to the narrowest intern perimeter of said support so that the respective cavity (39) and borders (40) of blocking are encased on this level (side pressure on the support). The foot (41) of the higher part (38) in prolongation of this perimeter rests on a base (42) of the lower part (37). The dispensing openings or liquid dispensing tube (11) of the cartridge reception device parts (37 and 38) coincide. According to the chosen closing device, a channel (30) for the strip (29), necessary side openings, a cylindrical cavity (34) to hold the spring (33), or perforated legs (25) and flexible tongue (27) for articulating and holding the closing nozzle lever (23) are envisaged.

Of course, the invention is not limited to the described modes of realization represented here as examples, but it includes also all the technical equivalents like their combinations.

The device according to the invention can be easily adaptable to all mineral water spring water bottles available in the market, whatever their size and volume (1 l, 1.5 l, 2 l, 5 l, etc.) and can also be applied for the service of various sweetened drinks, wines, hot drinks in insulating bottles (for parties or receptions). Transforming all bottles into genuine small individual fountain usable at the office, the house or in all small commercial, associative or liberal structures, for example.

The device according to the invention can be easily integrated in a complementary cooling or heating device, because it ensures its own liquid flow regulation and its own air intake flow without necessary additional adaptation except a simple reception device.

Figure 6:
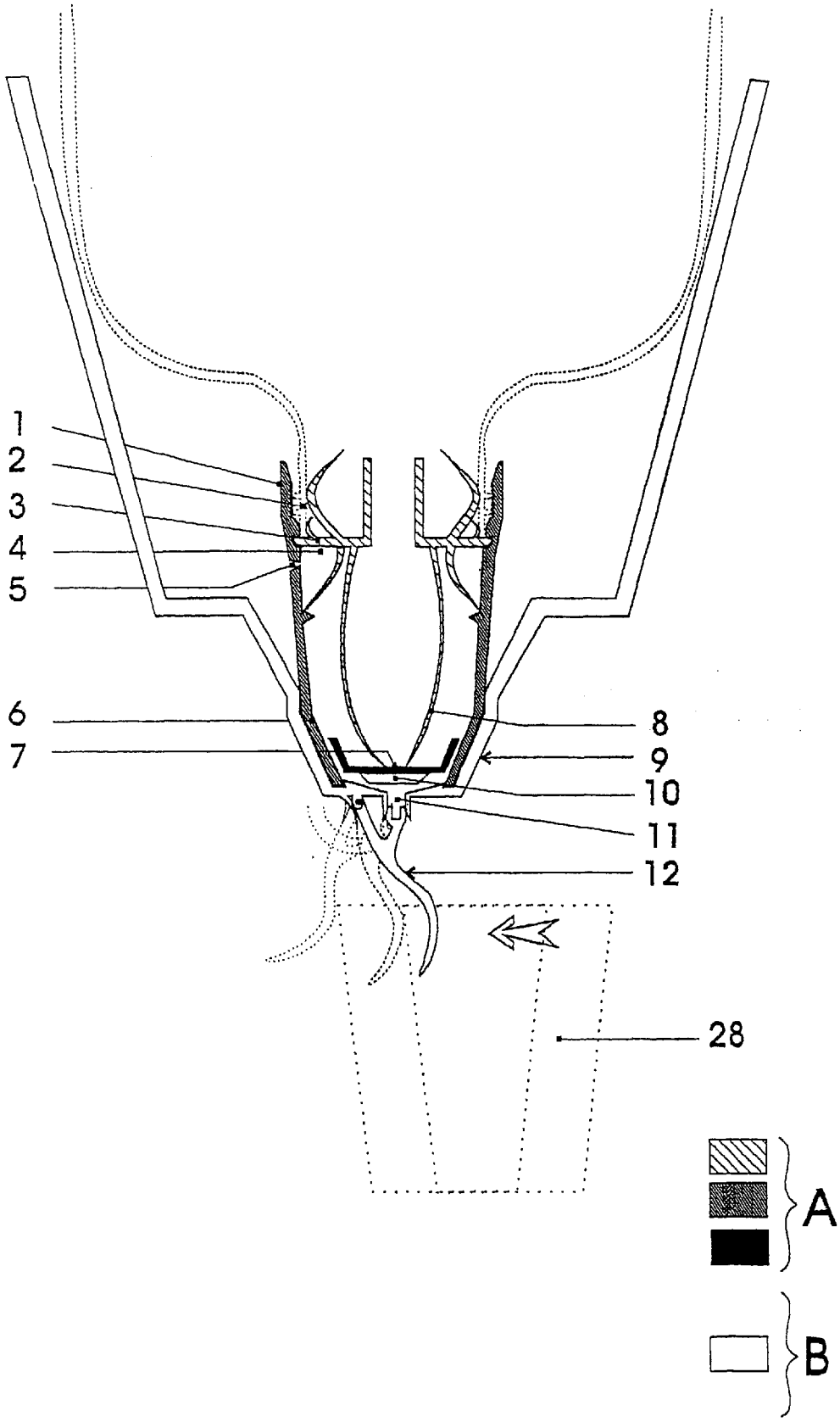
FIG. 6 represents a section of another alternative of the cartridge reception device and an application of the device of the invention: mural mouthwash liquid dispenser.

It also can, with adapted sizes and forms, standing on feet or hung up on a wall, be well adapted to hygiene for disinfectants liquids (FIG. 6: bathroom mouthwash dispenser) or domestic task: detergent or conditioner liquid dispenser.

The cartridge and the cartridge reception device can be manufactured out of plastic such as various polymers or resins of synthesis, or in all other appropriate material to the molding such as aluminum, stainless steel, etc or by combining them.

The cartridge reception device can easily be integrated into all kinds of light, portable or more consequent supports while allowing a great freedom of design.

What is claimed is:

1. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid; and a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior of the cartridge, the watertight valve having a shape which allows for vertical displacement toward the interior of the cartridge, the watertight valve being prolonged by a tube adapted to guide movement of the watertight valve precisely and to guide the liquid out when the watertight valve (7) is inserted into the cartridge (A).

2. A device according to claim 1, wherein the cartridge (A) comprises two concentrically juxtaposed fixation elements allowing a watertight connection to two different types of bottlenecks with one of the two types of bottleneck being significantly larger than another, said two fixation elements being concentrically located around the central passage of liquid flow (3*a*) and the central air passage allowing intake air to rise through the liquid (3*b*).

3. The fountain dispenser device of claim 1, further comprising a soft annular joint arranged between the watertight valve and the cartridge opening.

4. The fountain dispenser device of claim 1, further comprising a slightly widened ring and a corresponding male annular form, each located on one of the watertight valve and the cartridge opening.

5. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid;

a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior;

a complementary device (B) maintaining the cartridge firmly in vertical position, by means a receptacle (9) which closely embraces the cartridge (A) while allowing unrestricted air intake through the at least one air flow opening (5); and a protuberance (10), located at an inside bottom of the complementary device (B), the protuberance being arranged to push the valve (7) inside the cartridge (6) in order to release the liquid.

6. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid;

a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior;

a cartridge reception device (B) providing dispensing elements including, in one piece only attached by a lower thickness articulation zone (9*b*), a set of dispensing elements comprising a lever (12) including an element to raise the valve (7) inside the cartridge (A) in a form of a tubular protuberance (10*a*) which surmounts a central opening (11*a*) of the liquid dispensing lever (12), and at least one means of control in the form of a front-end pressure button (12*a*) and of a liquid dispensing lever (12*b*) located behind the central opening of the liquid dispensing lever (11*a*), the cartridge reception device being shaped to allow manufacturing in only one molding operation.

7. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid;

a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior; and a cartridge reception device (B) comprising a closing nozzle lever (23) held to an articulation axis (24) by perforated legs (25); said axis (24) being located close to the cartridge opening (11) so that an end of a lever closing device (26), as well as an end of the cartridge opening (11) are, at a shortest interval, on a circumvolution tangent around the articulation axis; the lever closing device (26) penetrating tightly the cartridge opening (11) having an end that is slightly conical with a rounded edge; the end of the lever closing device (26) being hollow and also of slightly conical and round shape; a flexible device (27) being located close to the articulation axis (24); the closing nozzle lever (23) having a form such that when pushed, the perpendicular axis to the opening (11) is completely free from any obstacle.

8. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid;

a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior;

a cartridge reception device (B) comprising a strip (29) which slips into a suitable channel (30), including on one end an opening (31) substantially equal to an opening of the cartridge reception device (11) and, at another end, a protuberance (32) retaining a spring (33) which causes a closing operation; said spring (33) being inserted in a cylindrical cavity of the cartridge reception device (34); an opening for fluid passage being obtained by a pressure on a contiguous lever (35) in prolongation of said strip.

9. A fountain dispenser device comprising:

a cartridge (A) having a shape so that the cartridge can be fixed in a watertight manner to a bottleneck, said cartridge comprising:

a first set of peripheral elements of air intake flow control located around a central passage of liquid flow (3*a*) and a central passage for allowing air admitted through the air intake flow control to rise through the liquid having openings laid out in circumvolution around the central passage of liquid flow (3*a*); the air intake flow control comprising an air pocket (4) supplied with at least one air flow opening (5) and retained by a membrane (4*a*) sensitive to pressure during inversion of the bottle, and to depression during discharging of the liquid;

a second central set of elements of liquid flow control, including a watertight valve (7) maintained firmly on a cartridge opening (11*a*) by an elastic device (8) pressed by force between a higher part (1*a*) and a lower part (1) of the cartridge (A); a lower part of the watertight valve (7) closely embracing walls around a dispensing opening of the cartridge (A) permitting flow of the liquid if a vertical pressure is exerted towards the interior; and a cartridge reception device (9), support (36), and opening mechanism (12); the cartridge reception device (9) being composed of a lower part (37) encasing itself under a higher part (38), the lower and higher parts embracing each other on a bottom and top of a narrowest internal perimeter of said support so that a cavity (39) and border (40) of the upper and lower parts are adapted to be retained by side pressure on the support, a foot (41) of the higher part (38) resting on a base (42) of the lower part (37); said lower and higher parts having dispensing openings coinciding with one another.

* * * * *